US010627127B2

(12) United States Patent
Ito

(10) Patent No.: US 10,627,127 B2
(45) Date of Patent: Apr. 21, 2020

(54) AIR CONDITIONER IN WHICH A FLAMMABLE REFRIGERANT FLOWS

(71) Applicant: Mitsubishi Electric Corporation, Tokyo (JP)

(72) Inventor: Daisuke Ito, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 52 days.

(21) Appl. No.: 15/755,666

(22) PCT Filed: Nov. 12, 2015

(86) PCT No.: PCT/JP2015/081827
§ 371 (c)(1),
(2) Date: Feb. 27, 2018

(87) PCT Pub. No.: WO2017/081786
PCT Pub. Date: May 18, 2017

(65) Prior Publication Data

US 2019/0024923 A1 Jan. 24, 2019

(51) Int. Cl.

| | |
|---|---|
| ***F28F 19/00*** | (2006.01) |
| ***F28F 19/02*** | (2006.01) |
| ***F24F 1/32*** | (2011.01) |
| ***F24F 1/34*** | (2011.01) |
| ***F24F 11/36*** | (2018.01) |

(Continued)

(52) U.S. Cl.

CPC ..... *F24F 11/36* (2018.01); *F24F 1/14* (2013.01); *F24F 1/26* (2013.01); *F24F 1/32* (2013.01); *F24F 1/34* (2013.01); *F25B 49/005* (2013.01); *F25B 49/02* (2013.01); *F28F 19/00* (2013.01);

(Continued)

(58) Field of Classification Search

CPC ..... F24F 1/14; F24F 1/26; F24F 1/30; F24F 1/32; F24F 1/34; F24F 11/36; F28F 19/00; F28F 19/02; F28F 19/06; F28F 2245/00

See application file for complete search history.

(56) References Cited

U.S. PATENT DOCUMENTS

2015/0233622 A1 8/2015 Yajima et al.

FOREIGN PATENT DOCUMENTS

| | | |
|---|---|---|
| CN | 1182187 A | 5/1998 |
| GB | 2530915 A | 4/2016 |

(Continued)

OTHER PUBLICATIONS

Extended EP Search Report dated Jan. 16, 2019 issued in corresponding EP patent application No. 15908306.2.

(Continued)

*Primary Examiner* — Edward F Landrum
*Assistant Examiner* — Daniel C Comings
(74) *Attorney, Agent, or Firm* — Posz Law Group, PLC

(57) ABSTRACT

Provided is an air conditioner which can suppress refrigerant leakage in a room and has a high safety even when using a flammable refrigerant. The air conditioner includes an indoor apparatus placed in a room, and an outdoor apparatus placed in an outside of the room separated from the room by a wall. The indoor apparatus includes a first refrigerant pipe in which a flammable refrigerant flows. The outdoor apparatus includes a second refrigerant pipe which is connected to the first refrigerant pipe and in which the flammable refrigerant flows. The second refrigerant pipe has a portion smaller in thickness than a minimum-thickness portion of the first refrigerant pipe.

10 Claims, 6 Drawing Sheets

(51) Int. Cl.

| | |
|---|---|
| ***F25B 49/02*** | (2006.01) |
| ***F28F 19/06*** | (2006.01) |
| ***F24F 1/26*** | (2011.01) |
| ***F24F 1/14*** | (2011.01) |
| ***F25B 49/00*** | (2006.01) |

(52) U.S. Cl.
CPC ..... *F28F 19/02* (2013.01); *F28F 19/06* (2013.01); *F28F 2245/00* (2013.01)

(56) References Cited

FOREIGN PATENT DOCUMENTS

| | | | |
|---|---|---|---|
| JP | 2001-099530 | A | 4/2001 |
| JP | 2001-165468 | A | 6/2001 |
| JP | 2001-165474 | A | 6/2001 |
| JP | 2002-130848 | A | 5/2002 |
| JP | 3454647 | B2 | 10/2003 |
| JP | 2005-298913 | A | 10/2005 |
| JP | 2012-211735 | A | 11/2012 |
| JP | 2013-178073 | A | 9/2013 |
| JP | 2014-020704 | A | 2/2014 |
| JP | 2014-159952 | A | 9/2014 |
| WO | 2012/043492 | A1 | 4/2012 |
| WO | 2014/203353 | A1 | 12/2014 |

OTHER PUBLICATIONS

Office action dated Mar. 12, 2019 issued in corresponding JP patent application No. 2017-549931 (and English translation thereof).
International Search Report of the International Searching Authority dated Feb. 2, 2016 for the corresponding international application No. PCT/JP2015/081827 (and English translation).
Office Action dated Nov. 1, 2019 issued in corresponding CN patent application No. 201580084347.1 (and English translation).
Office Action dated Jan. 29, 2020 issued in corresponding JP patent application No. 2017-549931 (and English translation).

AIR CONDITIONER IN WHICH A FLAMMABLE REFRIGERANT FLOWS

CROSS REFERENCE TO RELATED APPLICATION

This application is a U.S. national stage application of International Application No. PCT/JP2015/081827, filed on Nov. 12, 2015, the contents of which are incorporated herein by reference.

TECHNICAL FIELD

The present invention relates to an air conditioner, and in particular to an air conditioner which uses a refrigerant having flammability.

BACKGROUND

Conventionally, an anticorrosion layer is formed on an outer circumferential surface of a pipe in which refrigerant flows in an air conditioner, in order to prevent refrigerant leakage due to corrosion of the pipe.

Japanese Patent Laying-Open No. 2014-20704 (PTD 1) discloses a bonded body of pipe members, including an inner fitting pipe member and an outer fitting pipe member bonded by brazing, each outer circumferential surface of the inner fitting pipe member and the outer fitting pipe member having an anticorrosion layer formed thereon. A base material of the inner fitting pipe member and the outer fitting pipe member is made of aluminum or an aluminum alloy, and a predetermined amount of zinc, which has a potential lower than that of aluminum serving as the base material (which is more likely to corrode than aluminum), is mixed into the anticorrosion layer.

In addition, in a conventional air conditioner, since corrosion of a pipe is more likely to proceed in particular in an outside of a room, the thickness of a pipe placed in the outside of the room is provided to be equal to or more than the thickness of a pipe placed in the room. It should be noted that the thickness of a pipe used herein means a total thickness of a base material and an anticorrosion layer.

PATENT LITERATURE

PTD 1: Japanese Patent Laying-Open No. 2014-20704

In the conventional air conditioner, however, it is difficult to use a refrigerant having flammability (hereinafter referred to as a flammable refrigerant).

Specifically, when a flammable refrigerant is used for an air conditioner, it is required to reliably prevent leakage thereof in a room, rather than in an outside of the room. This is because, in the room in which, for example, a kitchen and the like are placed, there are more instruments and the like which may become a source of ignition than those in the outside of the room, and because the room is a closed space and a leaking refrigerant is likely to stagnate therein.

However, the conventional air conditioner does not assume use of such a flammable refrigerant, and anticorrosion design or pressure resistant design for suppressing refrigerant leakage in a room has not been made satisfactorily.

SUMMARY

The present invention has been made to solve the aforementioned problem. A main object of the present invention is to provide an air conditioner which can suppress refrigerant leakage in a room and has a high safety even when using a flammable refrigerant.

An air conditioner in accordance with the present invention includes an indoor apparatus placed in a room, and an outdoor apparatus placed in an outside of the room separated from the room by a wall. The indoor apparatus includes a first refrigerant pipe in which a flammable refrigerant flows. The outdoor apparatus includes a second refrigerant pipe in which the flammable refrigerant flows. The first refrigerant pipe and the second refrigerant pipe are connected to each other to constitute a refrigerant flow path in which the flammable refrigerant is enclosed. The second refrigerant pipe has a portion smaller in thickness than a minimum-thickness portion of the first refrigerant pipe.

According to the present invention, an air conditioner which can suppress refrigerant leakage in a room and has a high safety even when using a flammable refrigerant can be provided.

DETAILED DESCRIPTION

Figure 1:
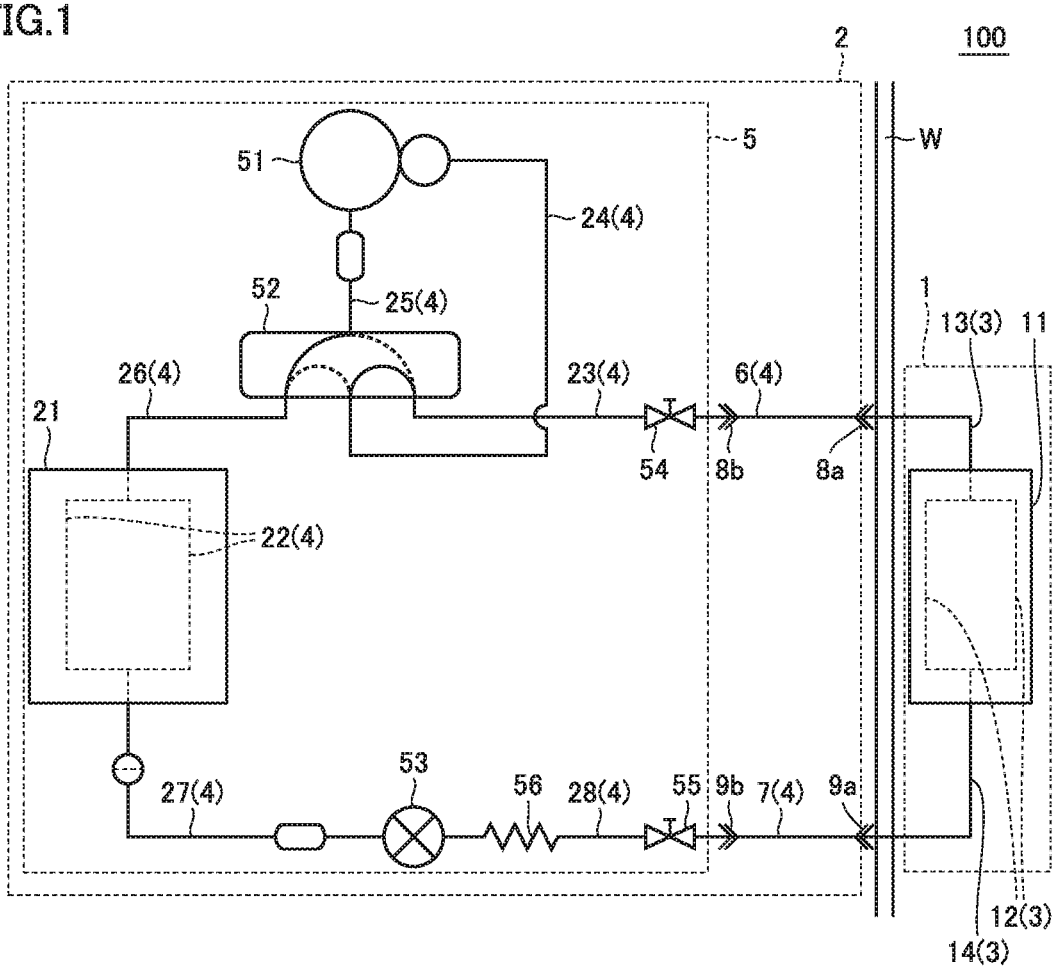
FIG. 1 is a view showing an air conditioner in accordance with a first embodiment.

Hereinafter, embodiments of the present invention will be described with reference to the drawings. It should be noted that, in the drawings below, identical or corresponding parts will be designated by the same reference numerals, and the description thereof will not be repeated.

First Embodiment

<Configuration of Air Conditioner>

An air conditioner 100 in accordance with a first embodiment will be described with reference to FIG. 1. Air conditioner 100 includes an indoor apparatus 1 placed in a room which is subjected to air conditioning by air conditioner 100, and an outdoor apparatus 2 placed in an outside of the room separated from the room by a wall W. Indoor apparatus 1 includes a first refrigerant pipe 3 in which a flammable refrigerant flows. Outdoor apparatus 2 includes a second refrigerant pipe 4 which is connected to first refrigerant pipe 3 and in which the flammable refrigerant flows. Second refrigerant pipe 4 has a portion smaller in thickness (hereinafter also referred to as a thinner portion) than a minimum-thickness portion of first refrigerant pipe 3. Here, the thickness of each pipe refers to a distance between an inner circumferential surface of each pipe in contact with the flammable refrigerant and an outer circumferential surface of each pipe in contact with an atmosphere in the room or in the outside of the room in which each pipe is placed. When first refrigerant pipe 3 is provided to have a uniform thickness, the minimum-thickness portion of first refrigerant pipe 3 refers to entire first refrigerant pipe 3. The flammable refrigerant includes any refrigerant having flammability. One end and the other end of first refrigerant pipe 3 are respectively connected to one ends of two pipes provided in wall W, the one ends facing an inside of the room. One end and the other end of second refrigerant pipe 4 are respectively connected to the other ends of the two pipes provided in wall W, the other ends facing the outside of the room.

In such an air conditioner 100, also at the time of use after a predetermined period has passed from the beginning of use, the thinner portion of second refrigerant pipe 4 (when the thickness varies in the thinner portion, a minimum-thickness portion thereof) serves as a minimum-thickness portion in the refrigerant pipes of air conditioner 100. Accordingly, even when air conditioner 100 is used until the refrigerant leaks from a refrigerant pipe damaged by corrosion, the refrigerant leakage occurs at the minimum-thickness portion of second refrigerant pipe 4 placed in the outside of the room. If second refrigerant pipe 4 is damaged and the refrigerant leaks in an amount more than a predetermined amount, air conditioner 100 becomes unusable. As a result, air conditioner 100 suppresses refrigerant leakage from first refrigerant pipe 3 placed in the room, and can safely use the flammable refrigerant as a heat medium, irrespective of the use period.

The thickness of the thinner portion of second refrigerant pipe 4 is, for example, more than or equal to a thickness which can prevent refrigerant leakage due to corrosion within a standard use period designed for air conditioner 100 (design standard use period). Thereby, air conditioner 100 can suppress occurrence of refrigerant leakage within the design standard use period. When air conditioner 100 is used for more than the design standard use period, no through hole is formed in first refrigerant pipe 3 before a through hole penetrating the inside and the outside of second refrigerant pipe 4 is formed in the thinner portion of second refrigerant pipe 4. Accordingly, air conditioner 100 can suppress occurrence of refrigerant leakage in the room even when it is used for more than the standard use period. It should be noted that refrigerant leakage in second refrigerant pipe 4 can be detected by any method (the details will be described later). Therefore, for air conditioner 100, an action such as replacement of air conditioner 100 can be taken at the timing when refrigerant leakage in second refrigerant pipe 4 is detected, for example.

Specific Example

Figure 2:
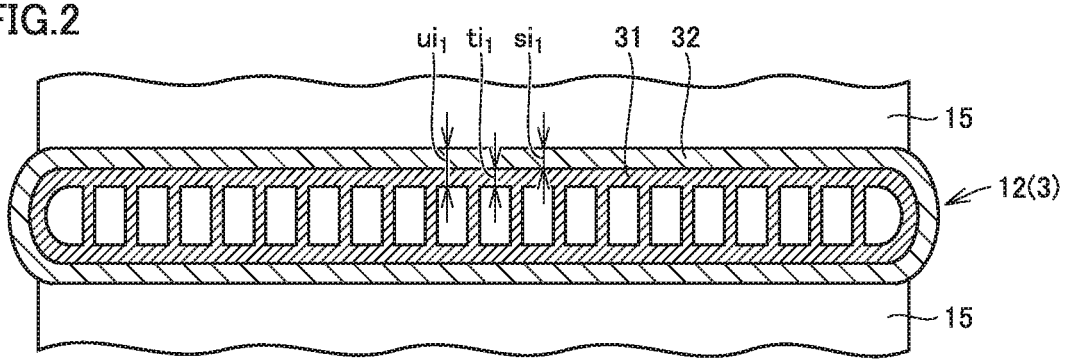
FIG. 2 is a cross sectional view showing a first refrigerant pipe (an indoor heat transfer pipe) of the air conditioner in accordance with the first embodiment.
Figure 3:
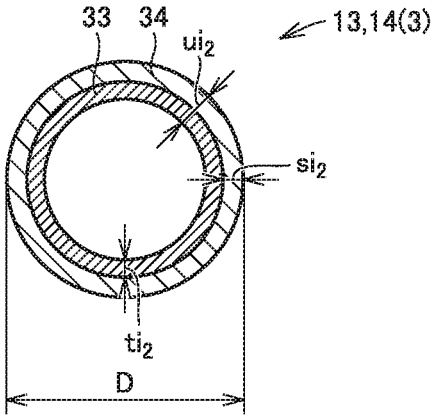
FIG. 3 is a cross sectional view showing the first refrigerant pipe (an indoor pipe) of the air conditioner in accordance with the first embodiment.
Figure 4:
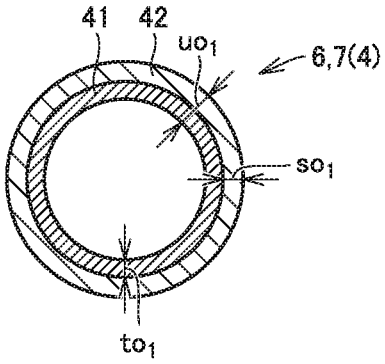
FIG. 4 is a cross sectional view showing a second refrigerant pipe (a connecting pipe) of the air conditioner in accordance with the first embodiment.
Figure 5:
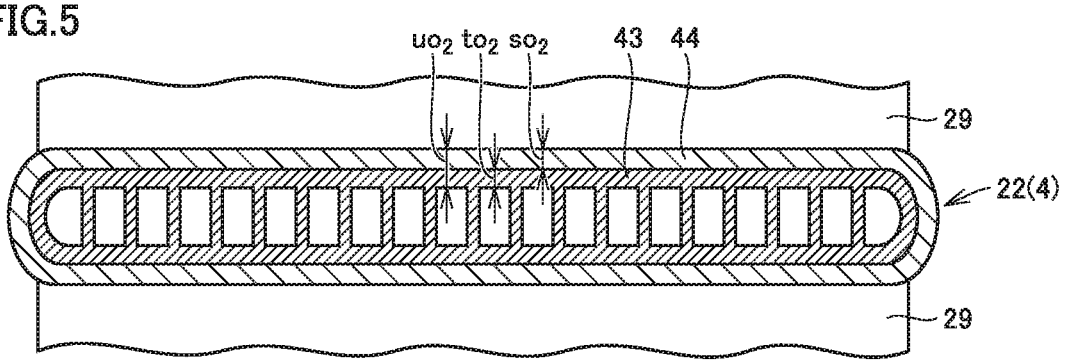
FIG. 5 is a cross sectional view showing the second refrigerant pipe (an outdoor heat transfer pipe) of the air conditioner in accordance with the first embodiment.
Figure 6:
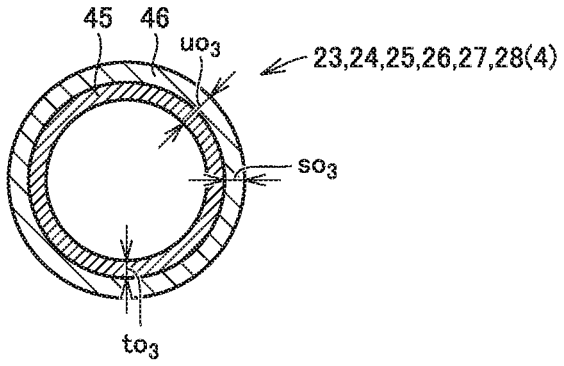
FIG. 6 is a cross sectional view showing the second refrigerant pipe (an outdoor pipe) of the air conditioner in accordance with the first embodiment.

Next, a specific example of air conditioner 100 in accordance with the first embodiment will be described with reference to FIGS. 1 to 5. FIG. 2 is a cross sectional view showing an indoor heat transfer pipe 12 constituting first refrigerant pipe 3. FIG. 3 is a cross sectional view showing indoor pipes 13 and 14 constituting first refrigerant pipe 3. FIG. 4 is a cross sectional view showing connecting pipes 6 and 7 constituting second refrigerant pipe 4. FIG. 5 is a cross sectional view showing an outdoor heat transfer pipe 22 constituting second refrigerant pipe 4. FIG. 6 is a cross sectional view showing outdoor pipes 23, 24, 25, 26, 27, and 28 (hereafter described as outdoor pipes 23 to 28) constituting second refrigerant pipe 4.

As shown in FIG. 1, indoor apparatus (indoor unit) 1 includes an indoor heat exchanger 11 which performs heat exchange between air in the room and the flammable refrigerant. Indoor heat exchanger 11 has a plurality of indoor heat transfer pipes 12 in which the flammable refrigerant flows. Indoor apparatus 1 further includes indoor pipes 13 and 14 respectively connected to one ends and the other ends of the plurality of indoor heat transfer pipes 12. The plurality of indoor heat transfer pipes 12 and indoor pipes 13 and 14 each constitute a portion of first refrigerant pipe 3.

As shown in FIG. 1, outdoor apparatus 2 includes an outdoor unit 5, and connecting pipes 6 and 7 which connect indoor apparatus 1 and outdoor unit 5. Outdoor unit 5 has an outdoor heat exchanger 21 which performs heat exchange between air in the outside of the room and the flammable refrigerant. Outdoor heat exchanger 21 has a plurality of outdoor heat transfer pipes 22 in which the flammable refrigerant flows. Further, outdoor unit 5 has a compressor 51, a four-way valve 52, an expansion valve 53, shut-off valves 54 and 55, a flow path resistor 56, outdoor pipes 23 to 28, and a case (not shown), for example. Compressor 51 can compress the flammable refrigerant. Four-way valve 52 can switch flow paths for the flammable refrigerant in air conditioner 100. Expansion valve 53 can expand the flammable refrigerant. Shut-off valves 54 and 55 can shut off or open the flow of the flammable refrigerant. Flow path resistor 56 can adjust a flow path resistance of the flammable refrigerant. Outdoor pipes 23 to 28 are provided such that the flammable refrigerant can flow therein, and connect the members. The case of outdoor unit 5 can house compressor 51, four-way valve 52, expansion valve 53, shut-off valves 54 and 55, flow path resistor 56, and outdoor pipes 23 to 28 therein. Connecting pipes 6, 7 are placed in an outside of the case of outdoor unit 5. The case of outdoor unit 5 and connecting pipes 6 and 7 are directly exposed to an outdoor environment (external environment) separated from the room by wall W. Connecting pipes 6 and 7, the plurality of outdoor heat transfer pipes 22, and outdoor pipes 23 to 28 each constitute a portion of second refrigerant pipe 4.

As shown in FIG. 1, connecting pipe 6 has one end connected to indoor pipe 13, and the other end connected to outdoor pipe 23. Connecting pipe 6 and indoor pipe 13 are connected via a first pipe provided in wall W. Connecting pipe 6 and the first pipe are connected via a flare portion 8*a*, for example. Connecting pipe 6 and outdoor pipe 23 are connected via a flare portion 8*b*, for example. Connecting pipe 7 has one end connected to indoor pipe 14, and the other end connected to outdoor pipe 28. Connecting pipe 7 and indoor pipe 14 are connected via a second pipe provided in wall W. Connecting pipe 7 and the second pipe are connected via a flare portion 9*a*, for example. Connecting pipe 7 and outdoor pipe 28 are connected via a flare portion 9*b*, for example.

As shown in FIG. 1, outdoor pipe 23 has one end connected to connecting pipe 6, and the other end, opposite to the one end, connected to one port (a first port) of four-way valve 52. One end of outdoor pipe 24 is connected to another port (a second port) of four-way valve 52 other than the first port. The other end of outdoor pipe 24 is connected to a discharge side of compressor 51. One end of outdoor pipe 25 is connected to a suction side of compressor 51. The other end of outdoor pipe 25 is connected to still another port (a third port) of four-way valve 52 other than the first and second ports. One end of outdoor pipe 26 is connected to still another port (a fourth port) of four-way valve 52 other than the first, second, and third ports. The other end of outdoor pipe 26 is connected to one ends of the plurality of outdoor heat transfer pipes 22. One end of outdoor pipe 27 is connected to the other ends of the plurality of outdoor heat transfer pipes 22. The other end of outdoor pipe 27 is connected to expansion valve 53. One end of outdoor pipe 28 is connected to expansion valve 53. The other end of outdoor pipe 28 is connected to connecting pipe 7. Outdoor pipe 23 has shut-off valve 54. Outdoor pipe 28 has shut-off valve 55 and flow path resistor 56.

As shown in FIG. 2, indoor heat transfer pipe 12 is a flat pipe, for example. Indoor heat transfer pipe 12 has a base material 31 and an anticorrosion layer 32, for example. Pores are formed in base material 31. Indoor heat exchanger 11 (see FIG. 1) further has a plurality of indoor fins 15, for example. Two adjacent indoor heat transfer pipes 12 are provided to face each other with one indoor fin 15 sandwiched therebetween. Indoor fin 15 is connected to an outer circumferential surface of anticorrosion layer 32 of indoor heat transfer pipe 12. Indoor heat transfer pipe 12 and indoor fin 15 are bonded by brazing, for example. As shown in FIG. 3, indoor pipes 13 and 14 have an annular sectional shape, for example. Indoor pipes 13 and 14 have a base material 33 (a first base material) and an anticorrosion layer 34 (a first anticorrosion portion), for example.

As shown in FIG. 4, connecting pipes 6 and 7 have an annular sectional shape, for example. Connecting pipes 6 and 7 have a base material 41 (a second base material) and an anticorrosion layer 42 (a second anticorrosion portion), for example.

As shown in FIG. 5, outdoor heat transfer pipe 22 is a flat pipe, for example. Outdoor heat transfer pipe 22 has a base material 43 and an anticorrosion layer 44, for example. Outdoor heat exchanger 21 (see FIG. 1) further has an outdoor fin 29 connected to outdoor heat transfer pipe 22, for example. Outdoor fin 29 is connected to an outer circumferential surface of anticorrosion layer 44 of outdoor heat transfer pipe 22. Outdoor heat transfer pipe 22 and outdoor fin 29 are bonded by brazing, for example. As shown in FIG. 6, outdoor pipes 23 to 28 have an annular sectional shape, for example. Outdoor pipes 23 to 28 have a base material 45 (the second base material) and an anticorrosion layer 46 (the second anticorrosion portion), for example.

Base materials 31, 33, 41, 43, and 45 have inner circumferential surfaces in contact with the flammable refrigerant, and outer circumferential surfaces in contact with anticorrosion layers 32, 34, 42, 44, and 46. Anticorrosion layers 32, 34, 42, 44, and 46 are provided on the outer circumferential surfaces of base materials 31, 33, 41, 43, and 45 to surround base materials 31, 33, 41, 43, and 45, respectively. Anticorrosion layers 32, 34, 42, 44, and 46 have inner circumferential surfaces in contact with base materials 31, 33, 41, 43, and 45, and outer circumferential surfaces in contact with the atmosphere in the room or in the outside of the room. The outer circumferential surfaces of base materials 31 and 33 are separated from the atmosphere in the room by anticorrosion layers 32 and 34, respectively. The outer circumferential surfaces of anticorrosion layers 32 and 34 are in contact with the atmosphere in the room. The outer circumferential surfaces of anticorrosion layers 42, 44, and 46 are in contact with the atmosphere in the outside of the room. The outer circumferential surfaces of base materials 41, 43, and 45 are separated from the atmosphere in the outside of the room by anticorrosion layers 42, 44, and 46, respectively. A material constituting base materials 31, 33, 41, 43, and 45 includes at least one of aluminum (Al) and copper (Cu), for example. A material constituting anticorrosion layers 32, 34, 42, 44, and 46 may be any material which includes a material having a standard electrode potential lower than (an ionization tendency higher than) that of the material constituting base materials 31, 33, 41, 43, and 45, and includes at least one selected from the group consisting of zinc (Zn), Al, and cadmium (Cd), for example. That is, anticorrosion layers 32, 34, 42, 44, and 46 are constituted of a material which is more likely to corrode than the material constituting base materials 31, 33, 41, 43, and 45. Anticorrosion layers 32, 34, 42, 44, and 46 may be constituted by winding a tape having an anticorrosion material applied thereto (for example, a Zn-sprayed tape) around base materials 31, 33, 41, 43, and 45. The anticorrosion material applied to the tape includes at least one selected from the group consisting of Zn, Al, and Cd. In this case, thicknesses $si_1$, $si_2$, $so_1$, $so_2$, and $so_3$ of anticorrosion layers 32, 34, 42, 44, and 46 (see FIGS. 2 to 6) can be adjusted by the number of turns of the tape described above.

The minimum-thickness portion of first refrigerant pipe 3 is provided in at least one of the plurality of indoor heat transfer pipes 12, for example. A thickness $ui_1$ of the plurality of indoor heat transfer pipes 12 (see FIG. 2) is thinner than each thickness $ui_2$ of indoor pipes 13 and 14 (see FIG. 3), for example. Thickness $ui_1$ of the plurality of indoor heat transfer pipes 12 and thickness $ui_2$ of indoor pipes 13 and 14 are provided to be thicker than corrosion amounts thereof estimated in the design standard use period for air conditioner 100.

Thickness $ui_1$ of indoor heat transfer pipe 12 is the sum of a thickness $ti_1$ of base material 31 (see FIG. 2) and thickness $si_1$ of anticorrosion layer 32 (see FIG. 2). It should be noted that thickness $ti_1$ of base material 31 is a distance between the inner circumferential surface of base material 31 in contact with the flammable refrigerant and the outer circumferential surface of base material 31 in contact with anticorrosion layer 32, as described above, and is not a thickness of a portion which separates the pores formed in base material 31. Thickness $ui_2$ of indoor pipes 13 and 14 is the sum of a thickness $ti_2$ of base material 33 (see FIG. 3) and thickness $si_2$ of anticorrosion layer 34 (see FIG. 3). Thickness $ti_1$ of base material 31 of indoor heat transfer pipe 12 is thinner than thickness $ti_2$ of base material 33 of indoor pipes 13 and 14, for example. Thickness $si_1$ of anticorrosion layer 32 of indoor heat transfer pipe 12 is equal to thickness $si_2$ of anticorrosion layer 34 of indoor pipes 13 and 14, for example. Thickness $ui_1$ of indoor heat transfer pipe 12 is a distance between an inner circumferential surface of indoor heat transfer pipe 12 in contact with the flammable refrigerant and an outer circumferential surface of indoor heat transfer pipe 12, as described above. When indoor heat transfer pipe 12 has a portion at which the distance between the inner circumferential surface and the outer circumferential surface is relatively long (a thick portion) and a portion at which the above distance is relatively short (a thin portion), thicknesses $ui_1$, $ti_1$, and $si_1$ respectively refer to thicknesses of indoor heat transfer pipe 12, base material 31, and anticorrosion layer 32 at a portion at which the above distance is shortest.

The minimum-thickness portion of second refrigerant pipe 4 is provided in connecting pipes 6 and 7, for example. A thickness $uo_1$ of connecting pipes 6 and 7 (see FIG. 4) is uniformly provided in a circumferential direction and an axial direction (extending direction), for example. Thickness $uo_1$ of connecting pipes 6 and 7 is thinner than a thickness $uo_2$ of outdoor heat transfer pipe 22 (see FIG. 5) and a thickness $uo_3$ of outdoor pipes 23 to 28 (see FIG. 6). Thickness $uo_1$ of connecting pipes 6 and 7 is thinner than thickness $ui_1$ of the minimum-thickness portion of first refrigerant pipe 3 (see FIG. 2). That is, connecting pipes 6 and 7 are minimum-thickness portions in first refrigerant pipe 3 and second refrigerant pipe 4 constituting a refrigerant flow path of air conditioner 100. Connecting pipes 6 and 7 are thinner portions which are smaller in thickness than the minimum-thickness portion of first refrigerant pipe 3.

Thickness $uo_1$ of connecting pipes 6 and 7 is more than or equal to a thickness which can prevent refrigerant leakage due to corrosion within the design standard use period for air conditioner 100. In other words, thickness $uo_1$ of connecting pipes 6 and 7 is provided to be thicker than a corrosion amount (an amount of reduction in thickness) of connecting pipes 6 and 7 estimated in the design standard use period for air conditioner 100. Thickness $uo_2$ of outdoor heat transfer pipe 22 is provided to be thicker than a corrosion amount of outdoor heat transfer pipe 22 estimated in the design standard use period for air conditioner 100. Thickness $uo_3$ of outdoor pipes 23 to 28 is provided to be thicker than a corrosion amount of outdoor pipes 23 to 28 estimated in the design standard use period for air conditioner 100.

Thickness $uo_1$ of connecting pipes 6 and 7 is the sum of a thickness $to_1$ of base material 41 and thickness $so_1$ of anticorrosion layer 42. Thickness $uo_2$ of outdoor heat transfer pipe 22 is the sum of a thickness $to_2$ of base material 43 and thickness $so_2$ of anticorrosion layer 44. Thickness $uo_3$ of outdoor pipes 23 to 28 is the sum of a thickness $to_3$ of base material 45 and thickness $so_3$ of anticorrosion layer 46.

Thickness $to_1$ of base material 41 of connecting pipes 6 and 7 is equal to thickness $to_2$ of base material 43 of outdoor heat transfer pipe 22, for example. Thickness $so_1$ of anticorrosion layer 42 of connecting pipes 6 and 7 is thinner than thickness $so_2$ of anticorrosion layer 44 of outdoor heat transfer pipe 22, for example. Thickness $to_2$ of base material 43 of outdoor heat transfer pipe 22 is equal to thickness $to_3$ of base material 45 of outdoor pipes 23 to 28, for example. Thickness $so_2$ of anticorrosion layer 44 of outdoor heat transfer pipe 22 is equal to thickness $so_3$ of anticorrosion layer 46 of outdoor pipes 23 to 28, for example. Thickness $uo_2$ of outdoor heat transfer pipe 22 is a distance between an inner circumferential surface of outdoor heat transfer pipe 22 in contact with the flammable refrigerant and an outer circumferential surface of outdoor heat transfer pipe 22, as described above. When outdoor heat transfer pipe 22 has a portion at which the distance between the inner circumferential surface and the outer circumferential surface is relatively long (a thick portion) and a portion at which the above distance is relatively short (a thin portion), thicknesses $uo_2$, $to_2$, and $so_2$ respectively refer to thicknesses of outdoor heat transfer pipe 22, base material 43, and anticorrosion layer 44 at a portion at which the above distance is shortest.

The thickness of a maximum-thickness portion of second refrigerant pipe 4 (at least one of outdoor heat transfer pipe 22 and outdoor pipes 23 to 28) is less than or equal to thickness $ui_1$ of the minimum-thickness portion of first refrigerant pipe 3 (see FIG. 2), for example. In other words, entire second refrigerant pipe 4 is provided to be thinner than the minimum-thickness portion of first refrigerant pipe 3. It should be noted that a portion of second refrigerant pipe 4 may be provided to be thinner than the minimum-thickness portion of first refrigerant pipe 3.

Next, an exemplary operation of air conditioner 100 in accordance with the present specific example will be described. Air conditioner 100 can perform air conditioning for increasing the temperature in the room (heating operation), or air conditioning for decreasing the temperature in the room (cooling operation), for example. During the heating operation, refrigerant flow paths indicated by solid lines in FIG. 1 are formed in four-way valve 52. In this case, indoor heat exchanger 11 functions as a condenser, and outdoor heat exchanger 21 functions as an evaporator. During the cooling operation, refrigerant flow paths indicated by broken lines in FIG. 1 are formed in four-way valve 52, and indoor heat exchanger 11 functions as an evaporator and outdoor heat exchanger 21 functions as a condenser.

Next, the function and effect of air conditioner 100 in accordance with the present specific example will be described. In air conditioner 100, outdoor apparatus 2 includes outdoor unit 5 having outdoor heat exchanger 21 which performs heat exchange between air in the outside of the room and the flammable refrigerant. Outdoor heat exchanger 21 has outdoor heat transfer pipe 22 in which the flammable refrigerant flows. Outdoor apparatus 2 further includes connecting pipes 6 and 7 which connect outdoor heat transfer pipe 22 and first refrigerant pipe 3, and outdoor heat transfer pipe 22 and connecting pipes 6 and 7 each constitute a portion of second refrigerant pipe 4. Connecting pipes 6 and 7 have a portion smaller in thickness (the thinner portion) than the minimum-thickness portion of first refrigerant pipe 3. Thickness $uo_1$ of connecting pipes 6 and 7 is provided to be thicker than the corrosion amount (the amount of reduction in thickness) of connecting pipes 6 and 7 estimated in the design standard use period for air conditioner 100.

Thereby, in air conditioner 100, even after a predetermined period (for example, the design standard period) has passed from the beginning of use, connecting pipe 6 or connecting pipe 7 serves as a minimum-thickness portion in the refrigerant pipes of air conditioner 100. Accordingly, air conditioner 100 can suppress occurrence of refrigerant leakage in the room within the standard use period and also after the period has passed, and has a high safety even when using the flammable refrigerant.

Further, concerning connecting pipes 6 and 7 placed in the outside of the room and placed in the outside of outdoor unit 5, a corrosion state thereof can be easily checked from the outside. Accordingly, with air conditioner 100 in accordance with the present specific example, whether there is a risk of refrigerant leakage can be easily checked through a periodical inspection and the like.

It should be noted that, for example in a case where corrosion proceeds very faster in connecting pipes 6 and 7 placed in the outside of outdoor unit 5 than in first refrigerant pipe 3 and second refrigerant pipe 4 (outdoor heat transfer pipe 22 and outdoor pipes 23 to 28) in outdoor unit 5, and it can be confirmed that corrosion of first refrigerant pipe 3 and second refrigerant pipe 4 (outdoor heat transfer pipe 22 and outdoor pipes 23 to 28) in outdoor unit 5 does not proceed at a time point when refrigerant leakage occurs in connecting pipe 6, 7, air conditioner 100 may be re-operated after connecting pipe 6, 7 is replaced. New connecting pipe 6, 7 replaced on this occasion preferably has a portion smaller in thickness than the minimum-thickness portion of first refrigerant pipe 3 at the time of replacement. Thereby, air conditioner 100 can suppress occurrence of refrigerant leakage in the room also after re-operation, and has a high safety even when using the flammable refrigerant.

While air conditioner 100 is suitable for an ordinary environment where corrosion of a refrigerant pipe is more likely to proceed in an outside of a room than in the room, air conditioner 100 is also suitable for an environment where corrosion of a refrigerant pipe is more likely to proceed in a room than in an outside of the room. In the latter case, it is only necessary that the thickness of first refrigerant pipe 3 is provided to be thicker than a corrosion amount of first refrigerant pipe 3 estimated in the design standard use period for air conditioner 100, and to be thicker than the thickness of the thinner portion (connecting pipes 6 and 7) of second refrigerant pipe 4 even after the design standard use period has passed.

Variation

Although the minimum-thickness portion of first refrigerant pipe 3 is provided in the plurality of indoor heat transfer pipes 12 in air conditioner 100 in accordance with the specific example described above, the present invention is not limited thereto. The minimum-thickness portion of first refrigerant pipe 3 may be provided in indoor pipes 13 and 14. Further, entire first refrigerant pipe 3 is provided to have a uniform thickness, and entire first refrigerant pipe 3 may be constituted as the minimum-thickness portion.

Although indoor heat transfer pipe 12 and outdoor heat transfer pipe 22 are flat pipes, and indoor pipes 13 and 14, connecting pipes 6 and 7, and outdoor pipes 23 to 28 are circular pipes in air conditioner 100 in accordance with the specific example described above, these sectional shapes may each be any shape.

Connecting pipes 6 and 7 may have a relatively thick portion and a relatively thin portion in the circumferential direction. In this case, the thin portion in the circumferential direction of connecting pipes 6 and 7 is the thinner portion which is thinner than the minimum-thickness portion of first refrigerant pipe 3. Further, connecting pipes 6 and 7 may have a relatively thick portion and a relatively thin portion in the axial direction. For example, a portion of each of connecting pipes 6 and 7 (a portion closer to one end or the other end of each of connecting pipes 6 and 7) closer to either one of flare portions 8*a*, 8*b*, 9*a*, and 9*b* may have a thickness relatively thinner than that of the other portion of each of connecting pipes 6 and 7. In this case, the portion of each of connecting pipes 6 and 7 is the thinner portion which is thinner than the minimum-thickness portion of first refrigerant pipe 3. Further, only either one of connecting pipes 6 and 7 may be provided as the thinner portion described above.

In air conditioner 100 in accordance with the specific example described above, first refrigerant pipe 3 and second refrigerant pipe 4 may each have any configuration as long as thickness $uo_1$ of the thinner portion of second refrigerant pipe 4 (see FIG. 4) is thinner than the thickness of the minimum-thickness portion of first refrigerant pipe 3. For example, thickness $ti_1$ of base material 31 of the minimum-thickness portion of first refrigerant pipe 3 (see FIG. 2) may be equal to thickness $to_1$ of base material 41 of the thinner portion of second refrigerant pipe 4 (see FIG. 4). In this case, thickness $si_1$ of anticorrosion layer 32 of the minimum-thickness portion of first refrigerant pipe 3 (see FIG. 2) is thicker than thickness $so_1$ of anticorrosion layer 42 of the thinner portion (see FIG. 4).

Further, thickness $ti_1$ of base material 31 of the minimum-thickness portion of first refrigerant pipe 3 may be thinner than thickness $to_1$ of base material 41 of the thinner portion of second refrigerant pipe 4. In this case, thickness $si_1$ of anticorrosion layer 32 of the minimum-thickness portion of first refrigerant pipe 3 (see FIG. 2) is thicker than thickness $so_1$ of anticorrosion layer 42 of the thinner portion (see FIG. 4).

Further, thickness $ti_1$ of base material 31 of the minimum-thickness portion of first refrigerant pipe 3 may be thicker than thickness $to_1$ of base material 41 of the thinner portion of second refrigerant pipe 4. In this case, thickness $si_1$ of anticorrosion layer 32 of the minimum-thickness portion of first refrigerant pipe 3 (see FIG. 2) may be thicker than thickness $so_1$ of anticorrosion layer 42 of the thinner portion (see FIG. 4). Thickness $si_1$ of anticorrosion layer 32 of the minimum-thickness portion of first refrigerant pipe 3 (see FIG. 2) may be equal to thickness $so_1$ of anticorrosion layer 42 of the thinner portion (see FIG. 4).

Preferably, thickness $si_1$ of anticorrosion layer 32 (the first anticorrosion portion) of the minimum-thickness portion of first refrigerant pipe 3 (see FIG. 2) is thicker than thickness $so_1$ of anticorrosion layer 42 (the second anticorrosion portion) of the thinner portion of second refrigerant pipe 4 (see FIG. 4). Such a first refrigerant pipe 3 has a fully enhanced resistance to corrosion, when compared with the thinner portion of second refrigerant pipe 4. Accordingly, air conditioner 100 including first refrigerant pipe 3 can suppress occurrence of refrigerant leakage in the room. If thickness $so_1$ of anticorrosion layer 42 of the thinner portion is provided to be thicker than a corrosion amount (an amount of reduction in thickness) of the thinner portion estimated in the design standard use period, first refrigerant pipe 3 is suppressed from being damaged by corrosion prior to second refrigerant pipe 4, even when air conditioner 100 is used for more than the design standard use period.

Second Embodiment

Next, an air conditioner in accordance with a second embodiment will be described. The air conditioner in accordance with the second embodiment has basically the same configuration as that of air conditioner 100 in accordance with the first embodiment, and differs from the latter in that the former has a limitation that each ratio ($si_1/ti_1$, $si_2/ti_2$) of thickness $si_1$, $si_2$ of anticorrosion layer 32, 34 (see FIGS. 2 and 3) to thickness $ti_1$, $ti_2$ of base material 31, 33 (see FIGS. 2 and 3) of first refrigerant pipe 3 (see FIG. 1) is more than or equal to 3% and less than or equal to 50%.

Since the above ratio ($si_1/ti_1$, $si_2/ti_2$) for first refrigerant pipe 3 is more than or equal to 3%, first refrigerant pipe 3 can fully satisfy the strength required for an ordinary air conditioner. Accordingly, the air conditioner in accordance with the second embodiment suppresses refrigerant leakage in a room, and has a high safety even when using a flammable refrigerant.

On the other hand, bonding of the pipes constituting first refrigerant pipe 3 or bonding between indoor heat transfer pipe 12 and indoor fin 15 is performed by brazing, for example. During heating for brazing, there occurs a phenomenon that a constituent of a brazing material diffuses into the base material. On this occasion, when the base material has a small thickness, so-called erosion, in which the substantial thickness of the base material decreases and leads to damage to the base material, is likely to occur. If the anticorrosion layer of the first refrigerant pipe has a too large thickness, it becomes necessary to limit the thickness of the base material of the first refrigerant pipe due to a constraint on external dimensions of the first refrigerant pipe, and occurrence of the above erosion is a concern.

In contrast, in the air conditioner in accordance with the second embodiment, since the above ratio ($si_1/ti_1$, $si_2/ti_2$) for first refrigerant pipe 3 is less than or equal to 50%, thickness $ti_1$, $ti_2$ of base material 31, 33 can be set to a thickness which can fully suppress occurrence of erosion. That is, in the air conditioner in accordance with the second embodiment, since the above ratio ($si_1/ti_1$, $si_2/ti_2$) for first refrigerant pipe 3 is more than or equal to 3% and less than or equal to 50%, first refrigerant pipe 3 has a sufficient strength, and occurrence of erosion in first refrigerant pipe 3 is fully suppressed. Accordingly, the air conditioner in accordance with the second embodiment suppresses refrigerant leakage in a room, and has a high safety even when using a flammable refrigerant.

Third Embodiment

Next, an air conditioner in accordance with a third embodiment will be described. The air conditioner in accordance with the third embodiment has basically the same configuration as that of air conditioner 100 in accordance with the first embodiment, and differs from the latter in that the former has a limitation that each ratio ($ui_1/D$, $ui_2/D$) of thickness $ui_1$, $ui_2$ (see FIGS. 2 and 3) of first refrigerant pipe 3 (see FIG. 1) to an outer diameter D (see FIG. 3) of first refrigerant pipe 3 is more than or equal to 6% and less than or equal to 38%. Here, outer diameter D refers to diameter D of a circle formed by an outermost circumferential surface of the anticorrosion layer (see FIG. 3) when the sectional shape of first refrigerant pipe 3 is circular, and refers to a hydraulic equivalent diameter (a diameter of a circle having an area equal to a cross sectional area A surrounded by the outermost circumferential surface of the anticorrosion layer) when the sectional shape of first refrigerant pipe 3 is not circular.

Figure 7:
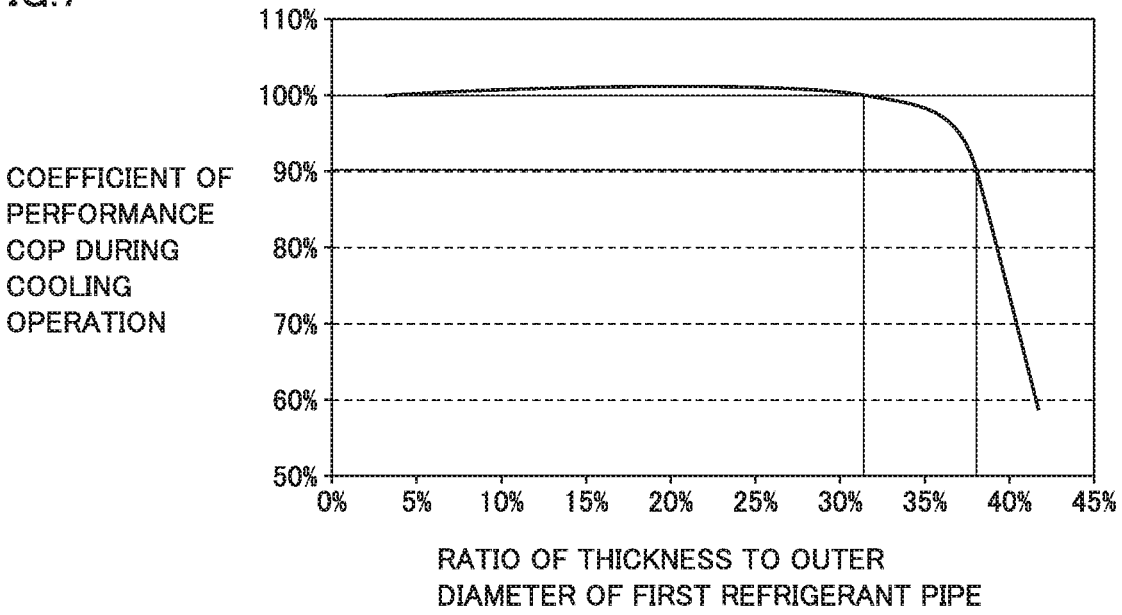
FIG. 7 is a graph showing the relation between the ratio of the thickness to the outer diameter of a first refrigerant pipe and the coefficient of performance COP during rated cooling operation in an air conditioner in accordance with a third embodiment.

FIG. 7 shows a result, obtained by calculation, of the relation between the ratio of the thickness to the outer diameter of first refrigerant pipe 3 and the coefficient of performance (COP) of the air conditioner during rated cooling operation, when the ratio of the thickness to the outer diameter of first refrigerant pipe 3 is set to be uniform ($ui_1/D=ui_2/D$). In FIG. 7, the axis of abscissas represents the ratio of the thickness to outer diameter D of first refrigerant pipe 3, and the axis of ordinates represents the coefficient of performance (COP) of the air conditioner during rated cooling operation.

It can be seen from FIG. 7 that, when the above ratio ($ui_1/D$, $ui_2/D$) is less than or equal to 38%, COP is more than or equal to 90%. That is, it has been confirmed that, when the above ratio ($ui_1/D$, $ui_2/D$) for first refrigerant pipe 3 is less than or equal to 38%, a reduction in cooling performance of the air conditioner can be suppressed. On the other hand, it has been confirmed that, when the above ratio is more than 38%, cooling performance is significantly reduced. If the thickness of the first refrigerant pipe is thickened to be more than a certain value, it becomes necessary to reduce the cross sectional area of the refrigerant flow path in the first refrigerant pipe due to a constraint on external dimensions of the first refrigerant pipe. In an air conditioner including such a first refrigerant pipe, pressure loss of the refrigerant flowing through the first refrigerant pipe is increased, and thus cooling performance is reduced in particular. When the above ratio ($ui_1/D$, $ui_2/D$) is less than or equal to 38%, a reduction in the cross sectional area of the refrigerant flow path in first refrigerant pipe 3 is suppressed, and it is considered that pressure loss of the refrigerant flowing through first refrigerant pipe 3 can be suppressed.

Since the above ratio ($ui_1/D$, $ui_2/D$) for first refrigerant pipe 3 is more than or equal to 6%, first refrigerant pipe 3 can fully satisfy the strength required for an ordinary air conditioner, even at the minimum-thickness portion. That is, the air conditioner in accordance with the third embodiment, in which the above ratio is more than or equal to 6% and less than or equal to 38%, has a high cooling performance, and suppresses refrigerant leakage from first refrigerant pipe 3 placed in a room, and thus can safely use a flammable refrigerant as a heat medium.

Further, if the cross sectional area of the refrigerant flow path in the first refrigerant pipe is reduced, surface tension which acts on a fluid flowing in the first refrigerant pipe is increased, and a refrigerator oil flowing through the refrigerant flow path of the air conditioner together with the refrigerant is likely to stagnate in the first refrigerant pipe. As a result, in an air conditioner including such a first refrigerant pipe, abnormalities such as clogging of the flow path due to the refrigerator oil, failure of the compressor due to poor circulation of the refrigerator oil, and the like are likely to occur.

In contrast, in the air conditioner in accordance with the third embodiment, since the above ratio is less than or equal to 38%, a reduction in the cross sectional area of the refrigerant flow path in first refrigerant pipe 3 is suppressed, and occurrence of the above abnormalities due to stagnation of the refrigerator oil is suppressed.

It can be seen from FIG. 7 that, when the above ratio ($ui_1/D$, $ui_2/D$) is more than or equal to 6% and less than or equal to 32%, COP is more than or equal to 100%. That is, it has been confirmed that, when the above ratio ($ui_1/D$, $ui_2/D$) for first refrigerant pipe 3 is more than or equal to 6% and less than or equal to 32%, the air conditioner can maintain a high cooling performance. Such an air conditioner suppresses refrigerant leakage in a room and has a high safety even when using a flammable refrigerant, has a high cooling performance, and further suppresses occurrence of the above abnormalities due to stagnation of the refrigerator oil.

Fourth Embodiment

Next, an air conditioner in accordance with a fourth embodiment will be described. The air conditioner in accordance with the fourth embodiment has basically the same configuration as that of the air conditioner in accordance with the first embodiment, and differs from the latter in that a material constituting first refrigerant pipe 3 (see FIG. 1) has a standard electrode potential at 25° C. (hereinafter described as a standard electrode potential (25° C.)) which is higher than that of a material constituting second refrigerant pipe 4 (see FIG. 1). From a different viewpoint, in the air conditioner in accordance with the fourth embodiment, the material constituting first refrigerant pipe 3 has an ionization tendency lower than that of the material constituting second refrigerant pipe 4.

A material constituting base materials 31 and 33 (see FIGS. 2 and 3) of first refrigerant pipe 3 has a standard electrode potential (25° C.) higher than that of a material constituting base materials 41, 43, and 45 (see FIGS. 4, 5, and 6) of second refrigerant pipe 4.

Table 1 shows examples of metal materials which can be adopted as the materials constituting first refrigerant pipe 3 and second refrigerant pipe 4, and standard electrode potentials (25° C.) thereof. The materials constituting first refrigerant pipe 3 and second refrigerant pipe 4 are each at least one selected from the group consisting of, for example, silver (Ag), Cu, lead (Pb), iron (Fe), Cd, Zn, Al, and material 1050-O, material 1050-H18, material 1200-O, material 3003-O, and material 3004-O as aluminum alloys. For example, the material constituting base materials 31 and 33 of first refrigerant pipe 3 is Cu, and the material constituting base materials 41, 43, and 45 of second refrigerant pipe 4 is Al.

TABLE 1

| Material | Standard Electrode Potential (25° C.) [V] |
|---|---|
| Ag | 0.800 |
| Cu | 0.345 |
| Pb | −0.126 |
| Fe | −0.440 |
| Zn | −0.762 |
| Al | −1.670 |
| 1050-O | −0.746 |
| 1050-H18 | −0.754 |
| 1200-O | −0.752 |
| 3003-O | −0.719 |
| 3004-O | −0.712 |

With such a configuration, corrosion is less likely to proceed in first refrigerant pipe 3 than in second refrigerant pipe 4, and thus the air conditioner in accordance with the fourth embodiment can prevent refrigerant leakage in a room more reliably than air conditioner 100.

On this occasion, anticorrosion layers 32 and 34 of first refrigerant pipe 3 and anticorrosion layers 42, 44, and 46 of second refrigerant pipe 4 may be constituted of the same material. Preferably, a material constituting anticorrosion layers 32 and 34 of first refrigerant pipe 3 has a standard electrode potential (25° C.) higher than that of a material constituting anticorrosion layers 42, 44, and 46 of second refrigerant pipe 4. In the latter case, the material constituting anticorrosion layers 32 and 34 of first refrigerant pipe 3 may be the same as the material constituting base materials 41, 43, and 45 of second refrigerant pipe 4. For example, the material constituting base materials 31 and 33 of first refrigerant pipe 3 may be Cu, the material constituting base materials 41, 43, and 45 of second refrigerant pipe 4 and the material constituting anticorrosion layers 32 and 34 of first refrigerant pipe 3 may be Al, and the material constituting anticorrosion layers 42, 44, and 46 of second refrigerant pipe 4 may be material 3003-O.

Further, base materials 31 and 33 of first refrigerant pipe 3 and base materials 41, 43, and 45 of second refrigerant pipe 4 may be constituted of the same material, and the material constituting anticorrosion layers 32 and 34 of first refrigerant pipe 3 may have a standard electrode potential (25° C.) higher than that of the material constituting anticorrosion layers 42, 44, and 46 of second refrigerant pipe 4. Also with such a configuration, corrosion is less likely to proceed in first refrigerant pipe 3 than in second refrigerant pipe 4, and thus the air conditioner in accordance with the fourth embodiment can prevent refrigerant leakage in a room more reliably than air conditioner 100.

Fifth Embodiment

Figure 8:
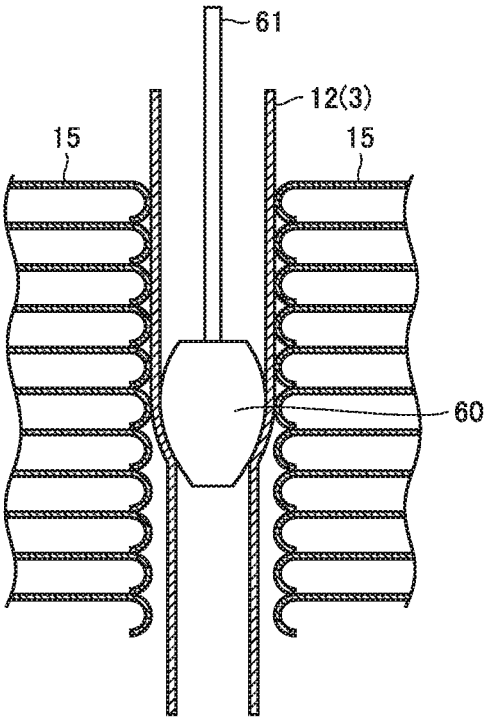
FIG. 8 is a cross sectional view for illustrating an exemplary method of connecting an indoor heat transfer pipe and indoor fins in an air conditioner in accordance with a fifth embodiment.

Next, an air conditioner in accordance with a fifth embodiment will be described with reference to FIGS. 8 and 9. The air conditioner in accordance with the fifth embodiment has basically the same configuration as that of air conditioner 100 in accordance with the first embodiment, and differs from the latter in that, in indoor heat exchanger 11, indoor heat transfer pipe 12 is connected to indoor fin 15 without hot welding (for example, brazing). Indoor heat transfer pipe 12 is pressure-bonded to indoor fin 15 by expansion of indoor heat transfer pipe 12. FIG. 8 is a cross sectional view showing an exemplary method of connecting indoor heat transfer pipe 12 and indoor fins 15 in the air conditioner in accordance with the fifth embodiment.

Referring to FIG. 8, indoor heat transfer pipe 12 is connected to indoor fins 15 by mechanical pipe expansion, for example. The mechanical pipe expansion is performed, for example, as described below. First, indoor heat transfer pipe 12 and a plurality of indoor fins 15 are prepared. Indoor heat transfer pipe 12 is a circular pipe having an annular sectional shape, for example. The plurality of indoor fins 15 are stacked in parallel with one another. A through hole through which indoor heat transfer pipe 12 can be inserted is formed in each indoor fin 15, and the through holes are formed to overlap one another in a direction in which the plurality of indoor fins 15 are stacked. Then, indoor heat transfer pipe 12 is inserted into the above through holes in the plurality of indoor fins 15. Then, into each hole provided in indoor heat transfer pipe 12, each of a plurality of pipe expansion balls 60 having a sectional shape according to the sectional shape of the hole is pushed by a rod 61. Thereby, indoor heat transfer pipe 12 is expanded and pressure-bonded to the plurality of indoor fins 15.

With such a configuration, indoor heat transfer pipe 12 is not heated to a high temperature and thus it does not become brittle, suppressing a reduction in strength and a reduction in resistance to corrosion due to embrittlement. Thereby, the air conditioner in accordance with the fifth embodiment can suppress refrigerant leakage in a room more reliably than air conditioner 100 in which indoor heat transfer pipe 12 is bonded to the plurality of indoor fins 15 by brazing.

Figure 9:
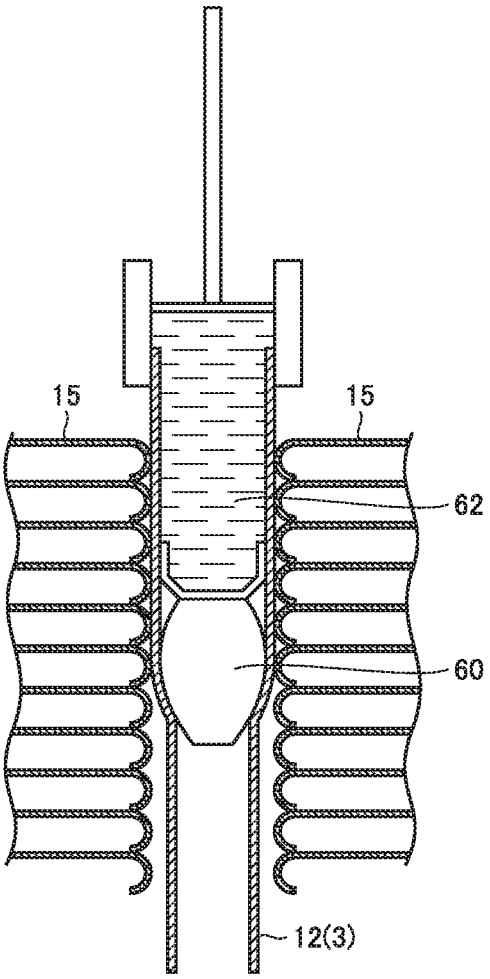
FIG. 9 is a cross sectional view for illustrating another exemplary method of connecting the indoor heat transfer pipe and the indoor fins in the air conditioner in accordance with the fifth embodiment.
Figure 10:
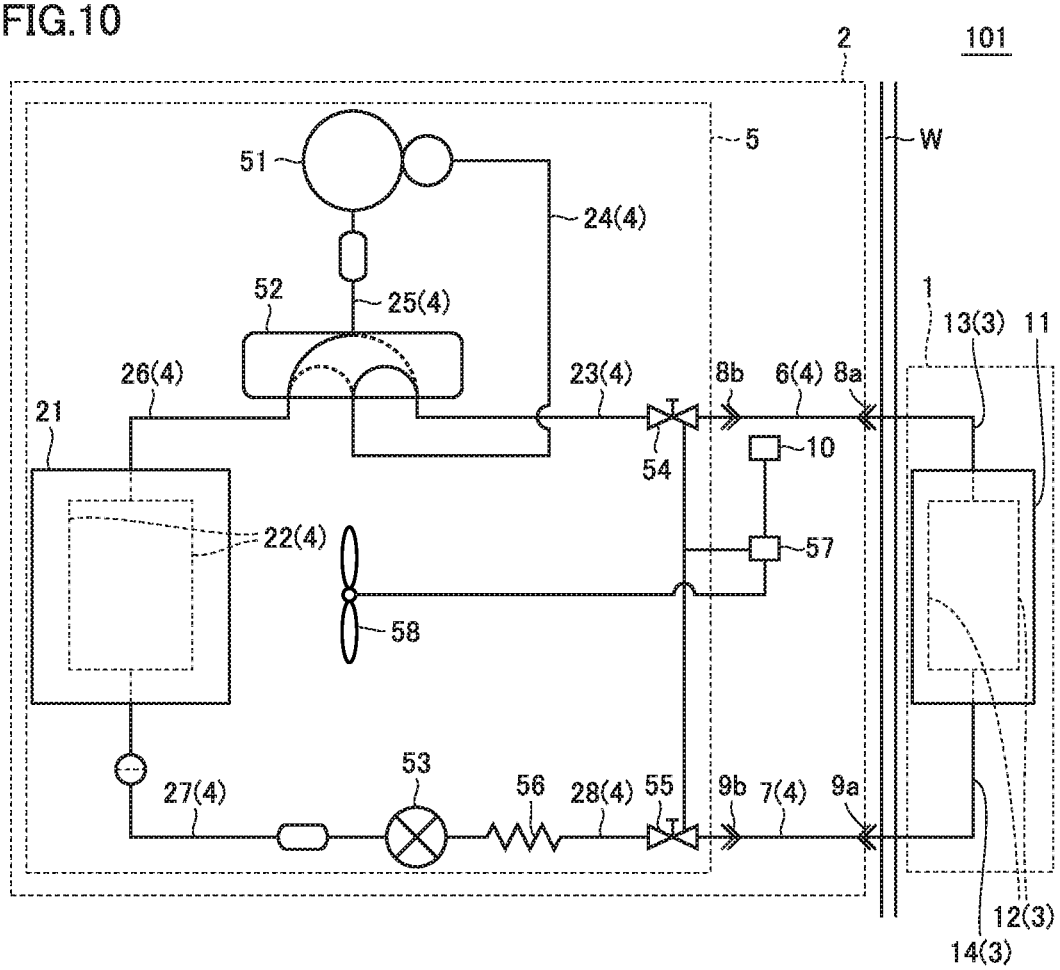
FIG. 10 is a view showing an air conditioner in accordance with a ninth embodiment.

FIG. 9 is a cross sectional view showing another exemplary method of connecting indoor heat transfer pipe 12 and indoor fins 15 in the air conditioner in accordance with the fifth embodiment. Referring to FIG. 9, indoor heat transfer pipe 12 may be connected to indoor fins 15 by liquid pressure pipe expansion, for example. The liquid pressure pipe expansion can be performed basically in the same way as the mechanical pipe expansion described above, and pipe expansion ball 60 is pushed into indoor heat transfer pipe 12 inserted into the above through holes in the plurality of indoor fins 15, by liquid pressure of a fluid 62. Thereby, indoor heat transfer pipe 12 is expanded and pressure-bonded to the plurality of indoor fins 15. In addition, indoor heat transfer pipe 12 may be connected to indoor fins 15 by gas pressure pipe expansion, for example. The gas pressure pipe expansion can be performed basically in the same way as the liquid pressure pipe expansion described above, and pipe expansion ball 60 (see FIG. 9) is pushed into indoor heat transfer pipe 12 inserted into the above through holes in the plurality of indoor fins 15, by gas pressure. Thereby, indoor heat transfer pipe 12 is expanded and pressure-bonded to the plurality of indoor fins 15.

Sixth Embodiment

Next, an air conditioner in accordance with a sixth embodiment will be described. The air conditioner in accordance with the sixth embodiment has basically the same configuration as that of air conditioner 100 in accordance with the first embodiment, and differs from the latter in that outdoor heat transfer pipe 22 (see FIGS. 1 and 4) is provided as a minimum-thickness portion of second refrigerant pipe 4.

Thickness $uo_2$ of outdoor heat transfer pipe 22 (see FIG. 5) is uniformly provided in the circumferential direction and the axial direction (extending direction), for example. Thickness $uo_2$ of outdoor heat transfer pipe 22 is thinner than thickness $uo_1$ of connecting pipes 6 and 7 (see FIG. 4) and thickness $uo_3$ of outdoor pipes 23 to 28 (see FIG. 6). Thickness $uo_2$ of outdoor heat transfer pipe 22 is thinner than thickness $ui_1$ of the minimum-thickness portion of first refrigerant pipe 3 (see FIG. 2). That is, outdoor heat transfer pipe 22 is a minimum-thickness portion in first refrigerant pipe 3 and second refrigerant pipe 4 constituting the refrigerant flow path of air conditioner 100. Outdoor heat transfer pipe 22 is a thinner portion which is smaller in thickness than the minimum-thickness portion of first refrigerant pipe 3.

In such an air conditioner, not only at the time of manufacturing but also at the time of use after a predetermined period has passed from the beginning of use, outdoor heat transfer pipe 22 serves as the thinner portion of second refrigerant pipe 4 (the minimum-thickness portion in the refrigerant pipes of the air conditioner). Also with such a configuration, the air conditioner in accordance with the sixth embodiment can suppress occurrence of refrigerant leakage in a room, and has a high safety even when using a flammable refrigerant.

Thickness $uo_2$ of outdoor heat transfer pipe 22 (see FIG. 5) at the time of manufacturing is thicker than the corrosion amount (the amount of reduction in thickness) of outdoor heat transfer pipe 22 estimated in the design standard use period, for example. In this case, the air conditioner in accordance with the sixth embodiment can suppress occurrence of refrigerant leakage in a room even when it is used for more than the design standard use period, and has a high safety even when using a flammable refrigerant.

Preferably, in the air conditioner in accordance with the sixth embodiment, thickness $si_1$ of anticorrosion layer 32 (the first anticorrosion portion) of the minimum-thickness portion of first refrigerant pipe 3 (see FIG. 2) is thicker than thickness $so_2$ of anticorrosion layer 44 (the second anticorrosion portion) of outdoor heat transfer pipe 22 (see FIG. 5).

Outdoor heat transfer pipe 22 may have a relatively thick portion and a relatively thin portion in the circumferential direction. In this case, the thin portion in the circumferential direction of outdoor heat transfer pipe 22 is the thinner portion which is thinner than the minimum-thickness portion of first refrigerant pipe 3. Further, outdoor heat transfer pipe 22 may have a relatively thick portion and a relatively thin portion in the axial direction. In this case, the portion of outdoor heat transfer pipe 22 is the thinner portion which is thinner than the minimum-thickness portion of first refrigerant pipe 3.

The thickness of a maximum-thickness portion of second refrigerant pipe 4 (at least one of connecting pipes 6 and 7 and outdoor pipes 23 to 28) is less than or equal to thickness $ui_1$ of the minimum-thickness portion of first refrigerant pipe 3 (see FIG. 2), for example. In other words, entire second refrigerant pipe 4 is provided to be thinner than the minimum-thickness portion of first refrigerant pipe 3. The thickness of the maximum-thickness portion of second refrigerant pipe 4 may be more than or equal to the thickness of the minimum-thickness portion of first refrigerant pipe 3. In other words, a portion of second refrigerant pipe 4 may be provided to be thicker than the minimum-thickness portion of first refrigerant pipe 3.

Seventh Embodiment

Next, an air conditioner in accordance with a seventh embodiment will be described. The air conditioner in accordance with the seventh embodiment has basically the same configuration as that of air conditioner 100 in accordance with the first embodiment, and differs from the latter in that entire second refrigerant pipe 4 is provided as a minimum-thickness portion of second refrigerant pipe 4. In other words, in the air conditioner in accordance with the seventh embodiment, second refrigerant pipe 4 (see FIG. 1) is provided to have a uniform thickness.

In such an air conditioner, entire second refrigerant pipe 4 serves as a portion thinner than the minimum-thickness portion of first refrigerant pipe 3 (a minimum-thickness portion in the refrigerant pipes of the air conditioner). Also with such a configuration, the air conditioner in accordance with the seventh embodiment can suppress occurrence of refrigerant leakage in a room, and has a high safety even when using a flammable refrigerant. The thickness of entire second refrigerant pipe 4 at the time of manufacturing is thicker than the corrosion amount (the amount of reduction in thickness) of second refrigerant pipe 4 estimated in the design standard use period, for example. In this case, the air conditioner in accordance with the seventh embodiment can suppress occurrence of refrigerant leakage in a room in the design standard use period, and has a high safety even when using a flammable refrigerant.

Eighth Embodiment

Next, an air conditioner in accordance with an eighth embodiment will be described. The air conditioner in accordance with the eighth embodiment has basically the same configuration as that of the air conditioner in accordance with the first embodiment, and differs from the latter in that the former has a limitation that the flammable refrigerant used as a heat medium includes a refrigerant including at least one of propylene-based carbon fluoride and ethylene-based carbon fluoride, which have a slight flammability and a low global warming potential (GWP).

The refrigerant including propylene-based carbon fluoride is R1234yf, R1234ze, or the like, for example. The refrigerant including ethylene-based carbon fluoride is R1123, R1132, or the like, for example.

Since the air conditioner in accordance with the eighth embodiment has the same configuration as air conditioner 100 in accordance with the first embodiment, the former can prevent leakage of the above flammable refrigerant in a room. Further, the refrigerant including at least one of propylene-based carbon fluoride and ethylene-based carbon fluoride as described above has a GWP of less than 150. Accordingly, the air conditioner in accordance with the eighth embodiment has less impact on global warming, and can satisfy the regulatory value (a GWP of less than 150) under the European F gas regulation.

Ninth Embodiment

Next, an air conditioner 101 in accordance with a ninth embodiment will be described. Air conditioner 101 in accordance with the ninth embodiment has basically the same configuration as that of air conditioner 100 in accordance with the first embodiment, and differs from the latter in that outdoor apparatus 2 further includes a detection unit 10 which is placed close to the portion smaller in thickness (thinner portion) of second refrigerant pipe 4, and can detect leakage of a flammable refrigerant.

Detection unit 10 may have any configuration as long as it can detect leakage of the flammable refrigerant. When the thinner portion is provided on connecting pipe 6 in second refrigerant pipe 4, detection unit 10 is placed close to connecting pipe 6.

When refrigerant leakage in second refrigerant pipe 4 is detected by detection unit 10, operation of air conditioner 101 is stopped by shutting off shut-off valves 54 and 55, for example. With such a configuration, air conditioner 101 can early detect refrigerant leakage in second refrigerant pipe 4 using detection unit 10, and thus can reduce the amount of leakage of the flammable refrigerant.

Outdoor unit 5 may further include an outdoor fan 58 which can blow air to outdoor heat exchanger 21. When refrigerant leakage in second refrigerant pipe 4 is detected by detection unit 10, operation of air conditioner 101 is stopped by shutting off shut-off valves 54 and 55, for example, and operation of outdoor fan 58 is continued. With such a configuration, air conditioner 101 can reduce the amount of leakage of the flammable refrigerant, and can diffuse the leaking flammable refrigerant using air flow generated by outdoor fan 58.

Outdoor apparatus 2 may further include a control unit 57 which is connected to detection unit 10 and shut-off valves 54 and 55, and is provided to be able to shut off shut-off valves 54 and 55 when refrigerant leakage is detected by detection unit 10.

When the thinner portion of second refrigerant pipe 4 has a relatively thick portion and a relatively thin portion, in other words, when a portion of the thinner portion is a minimum-thickness portion of second refrigerant pipe 4, detection unit 10 is preferably placed close to the minimum-thickness portion. When the thinner portion and minimum-thickness portion of second refrigerant pipe 4 is provided on outdoor heat transfer pipe 22 as in the air conditioner in accordance with the sixth embodiment, detection unit 10 is preferably placed close to outdoor heat transfer pipe 22. When entire second refrigerant pipe 4 is provided as the thinner portion and minimum-thickness portion as in the air conditioner in accordance with the seventh embodiment, detection unit 10 only needs to be placed close to any portion of second refrigerant pipe 4.

The thinner portion and minimum-thickness portion of second refrigerant pipe 4 may be provided in outdoor pipes 23 to 28. In this case, detection unit 10 only needs to be placed close to the minimum-thickness portion of outdoor pipes 23 to 28. Further, the thinner portion and minimum-thickness portion of second refrigerant pipe 4 may be provided at a plurality of places in connecting pipes 6 and 7, outdoor heat transfer pipe 22, and outdoor pipes 23 to 28. In this case, detection unit 10 is placed close to each minimum-thickness portion, one by one, for example.

Although the embodiments of the present invention have been described above, it is originally intended to combine features of the embodiments described above as appropriate.

Although the embodiments of the present invention have been described above, it is also possible to modify the embodiments described above in various manners. Further, the scope of the present invention is not limited to the embodiments described above. The scope of the present invention is defined by the scope of the claims, and is intended to include any modifications within the scope and meaning equivalent to the scope of the claims.

INDUSTRIAL APPLICABILITY

The present invention is particularly advantageously applicable to an air conditioner which uses a flammable refrigerant as a heat medium.

The invention claimed is:

1. An air conditioner comprising:

an indoor apparatus placed in a room; and an outdoor apparatus placed in an outside of the room separated from the room by a wall, the indoor apparatus including a first refrigerant pipe in which a flammable refrigerant flows, the outdoor apparatus including a second refrigerant pipe which is connected to the first refrigerant pipe and in which the flammable refrigerant flows, the second refrigerant pipe having a portion smaller in thickness than a minimum-thickness portion of the first refrigerant pipe, the first refrigerant pipe having a first base material in contact with the flammable refrigerant, and a first anticorrosion portion provided to surround an outer circumference of the first base material, the second refrigerant pipe having a second base material in contact with the flammable refrigerant, and a second anticorrosion portion provided to surround an outer circumference of the second base material, and a thickness of the first anticorrosion portion being thicker than a thickness of the second anticorrosion portion.

2. The air conditioner according to claim 1, wherein a maximum-thickness portion of the second refrigerant pipe being smaller in thickness than the minimum-thickness portion of the first refrigerant pipe.

3. The air conditioner according to claim 1, wherein:

the first refrigerant pipe has the first base material in contact with the flammable refrigerant, and the first anticorrosion portion provided to surround an outer circumference of the first base material, and a ratio of a thickness of the first anticorrosion portion to a thickness of the first base material is more than or equal to 3% and less than or equal to 50%.

4. The air conditioner according to claim 1, wherein a ratio of a thickness of the first refrigerant pipe to an outer diameter of the first refrigerant pipe is more than or equal to 6% and less than or equal to 38%.

5. The air conditioner according to claim 1, wherein a material constituting the first refrigerant pipe has a standard electrode potential higher than that of a material constituting the second refrigerant pipe.

6. The air conditioner according to claim 1, wherein:

the indoor apparatus has an indoor heat exchanger which performs heat exchange between air in the room and the flammable refrigerant, the indoor heat exchanger has a fin, and an indoor heat transfer pipe which is connected to the fin and in which the flammable refrigerant flows, and the indoor heat transfer pipe is pressure-bonded to the fin by expansion of the indoor heat transfer pipe.

7. The air conditioner according to claim 1, wherein:

the outdoor apparatus includes an outdoor unit having an outdoor heat exchanger which performs heat exchange between air in the outside of the room and the flammable refrigerant, the outdoor heat exchanger has an outdoor heat transfer pipe in which the flammable refrigerant flows, the outdoor apparatus further includes a connecting pipe which connects the outdoor heat transfer pipe and the first refrigerant pipe, the outdoor heat transfer pipe and the connecting pipe each constitute a portion of the second refrigerant pipe, and the connecting pipe has a minimum-thickness portion of the second refrigerant pipe.

8. The air conditioner according to claim 1, wherein:

the outdoor apparatus includes an outdoor unit having an outdoor heat exchanger which performs heat exchange between air in the outside of the room and the flammable refrigerant, the outdoor heat exchanger has an outdoor heat transfer pipe in which the flammable refrigerant flows, the outdoor apparatus further includes a connecting pipe which connects the outdoor heat transfer pipe and the first refrigerant pipe, the outdoor heat transfer pipe and the connecting pipe each constitute a portion of the second refrigerant pipe, and the outdoor heat transfer pipe has a minimum-thickness portion of the second refrigerant pipe.

9. The air conditioner according to claim 1, wherein the flammable refrigerant includes at least one of propylene-based carbon fluoride and ethylene-based carbon fluoride.

10. The air conditioner according to claim 1, wherein the outdoor apparatus further includes a detection unit which is placed close to the portion smaller in thickness of the second refrigerant pipe, and can detect leakage of the flammable refrigerant.

* * * * *